US007221770B2

(12) United States Patent
Fickweiler et al.

(10) Patent No.: US 7,221,770 B2
(45) Date of Patent: May 22, 2007

(54) CONNECTION PIECE FOR HEARING DEVICE SUPPORT HOOK

(75) Inventors: Werner Fickweiler, Bubenreuth (DE); Michael Sattler, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 483 days.

(21) Appl. No.: 10/896,657

(22) Filed: Jul. 22, 2004

(65) Prior Publication Data

US 2005/0020127 A1 Jan. 27, 2005

(30) Foreign Application Priority Data

Jul. 22, 2003 (DE) ..... 103 33 293

(51) Int. Cl.
*H04R 25/00* (2006.01)

(52) U.S. Cl. ..... 381/330; 381/381

(58) Field of Classification Search ..... 381/322, 381/324, 327–328, 330, 381; 181/129–130; 379/430

See application file for complete search history.

(56) References Cited

U.S. PATENT DOCUMENTS 5,606,621 A * 2/1997 Reiter et al. ..... 381/330
5,761,319 A * 6/1998 Dar et al. ..... 381/330
6,009,183 A * 12/1999 Taenzer et al. ..... 381/330

OTHER PUBLICATIONS

Siemens Service HdO, Gerät/BTE Instrument SIGNIA S, Bezugsnummer 72 06 399 Ausgabe 02.2003 AMI HJ, w/ translation.

* cited by examiner

*Primary Examiner*—Suhan Ni
(74) *Attorney, Agent, or Firm*—Schiff Hardin LLP

(57) ABSTRACT

In a behind-the-ear hearing device with a detachable support hook fastened to the hearing device, a narrow structural shape is enabled in the transition region between the support hook and the hearing device housing. The invention provides a one-part, metallic connection piece for a hearing device support hook, with a sound channel passing through this connection piece, with a fastening section, a stop and a fastening clip, such that forces affecting the connection piece over a plurality of regions of the connection piece can be passed into the housing of the hearing device. In comparison with a connection piece with a single region provided for force transfer, the cross-section of the hearing device housing can thereby be reduced in the region of the connection piece.

10 Claims, 3 Drawing Sheets

CONNECTION PIECE FOR HEARING DEVICE SUPPORT HOOK

BACKGROUND OF THE INVENTION

The invention concerns a one-part, metallic connection piece for a hearing device support hook, with a sound channel passing through this connection piece.

Behind-the-ear hearing aids are typically fastened on a support hook behind the ear of the hearing device user. In addition to the fastening of the hearing device behind the ear, the support hook normally fulfills an additional function. Namely, a sound channel normally passes through it via which the sound generated via a speaker arranged in the hearing device is conveyed to a sound tube connected with the forward end of the support hook, and via this sound tube and an ear fitting piece, into the auditory canal of the hearing device user.

It is preferable, for cosmetic reasons, and also to increase the wearing comfort with behind-the-ear hearing devices, to have optimally small and narrow housing structural shapes.

In the behind-the-ear hearing device SIGNIA S produced by Siemens Audiologische Technik GmbH, the support hooks are comprised of a curved titanium tube which is partially extrusion-coated by plastic material. This tube is continuous from the attachment point at the earpiece to the forward end of the support hook.

For attachment and affixing, a fastening clip made from plastic is molded on between the actual hearing device housing and the support hook, this fastening clip comprising a bore through which an attachment screw is guided. This known hearing device in fact exhibits a particularly slim structural shape between the actual hearing device housing and the support hooks; however, the housing of the hearing device must always be open to an exchange of the support hook. A screw connection for the support hook is not possible with this structural shape since the titanium tube cannot be provided with a threading.

Furthermore, behind-the-ear hearing devices with a metal connection piece are known that comprise a threading at the forward end of the connection piece. A support hook can be screwed onto the threading. This enables a simple exchange of the support hook in the event of repair. In the known connection piece, a catch/stop via which the connection piece is attached and affixed in the housing of the hearing device is located behind the winding. Via this catch, the relatively high turning and bending moments, particularly those generated upon screwing on and removal of the support hook, are transferred from the connection piece to the hearing device housing. This known solution has the advantage that, in the transition region between the actual hearing device housing and the support hook, relatively large forces are transferred to a narrowly limited region of the hearing device housing, whereby this forward housing region can not exceed a specific structural size.

SUMMARY OF THE INVENTION

It is the object of the present invention to enable a narrow structural shape in a behind-the-ear hearing device with a detachable support hook that can be fastened to the hearing device in the transition region between the support hook and the actual hearing device housing.

This object is achieved via a one-part, metallic connection piece, with a sound channel running through it, for a hearing device support hook with a fastening section for detachable fastening of the support hook, a stop connecting to the fastening piece, a curved and/or angled first tube section connecting to the fastening piece, a second tube section, and a connection clip that is arranged between the first tube section and the second tube section.

The use of a connection piece according to various embodiments of the invention discussed below brings a series of advantages. Thus, in comparison with the known hearing device with a titanium tube, an extrusion coating with plastic is done away with, whereby the manufacturing expenditure is reduced and the production costs can be lowered. Furthermore, in contrast to the titanium tube, the connection piece comprises a fastening section, such that a support hook can be connected with the connection piece or detached from it in a simple manner and without opening the actual hearing device housing. In particular, this support hook can also be completely produced from a transparent plastic material and a sound channel can pass through it, achieving cosmetic advantages. Due to the possibility of a support hook that is simple to exchange, further variation possibilities result with regard to the size and the bending radius of the support hook, as well as the sound channel length and the sound channel diameter.

In contrast to the further known connection piece with a threading part for detachable connection with a support hook, in the connection piece, the stop in connection with the fastening section is relatively small. Nevertheless, in order to absorb relatively high turning and bending moments occurring over the connection piece in the fastening of the support hook, and in order to be able to lead into the housing of the hearing device, the connection piece is provided with a fastening clip. The fastening clip does not thereby connect directly to the stop, but rather the connection piece comprises a short tube section between the stop and the fastening clip. This tube segment is preferably buckled or bent or provided with a curve in the connection region at the stop or the fastening clip. The entire connection piece, thus the fastening segment, the stop, the tube section and the fastening clip, are produced as one part from a metal or a metal alloy.

Via the division of the fastening mechanism in the stop and the fastening clip, the relatively high turning and bending moments occurring in the fastening of the support hook are absorbed via a relatively large lever/moment arm created by this division and are passed into the hearing device housing. Furthermore, the stop fashioned relatively small and the uneven curve of the sound channel connected thereto enable a particularly narrow structural shape in the transition region between the actual hearing device housing and the support hook.

To attach and affix the connection piece in the housing of the hearing device, the stop and the fastening clip engage in correspondingly shaped recesses of the housing. However, the fastening clip is preferably provided with a bore through which a further fastening element (for example a screw or a bolt) is directed. The lever arm to absorb forces via the connection piece and to pass these forces into the hearing device housing is thereby additionally enlarged. Furthermore, the housing part can be held together with such a screw given a multipart housing shell of the hearing device housing.

There are a plurality of possibilities to fasten the support hook at the forward end of the connection piece: on the one hand, a fastening segment can be executed as a threading at the forward end of the stop piece. The support hook can then be fastened to the connection piece via a screw motion and released from this as needed. However, other attachment possibilities can also be selected, such as a latch or a close fit.

Given the use of a threading or latch connection, additional measures should be taken in order to also attain an optimally sealed sound channel in the transition region. For example, the forward region of the stop axial and/or radial sealing surfaces can be provided that cooperate with corresponding sealing surfaces of the support hook and thereby effect a good sealing of the sound channel.

Finally, the connection piece can also be fashioned curved or bent at the rear end opposite the fastening segment in order to enable an optimal connection to the wearer of the hearing device. A short piece of sound tube is thereby advantageously used between the rear end of the connection piece and the sound support of the wearer.

DESCRIPTION OF THE DRAWINGS

The invention is subsequently explained in detail using exemplary embodiments illustrated in the drawings.

DETAILED DESCRIPTION OF THE PREFERRED EMBODIMENTS

Figure 1:
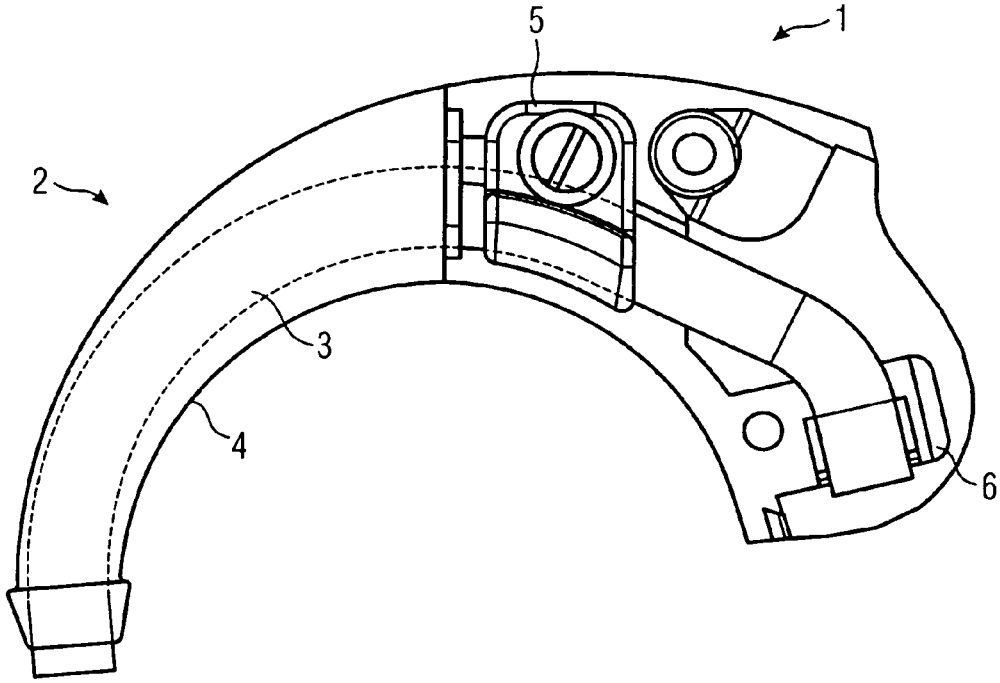
FIG 1 Prior art
FIG. 1 is a pictorial diagram illustrating the design of the support hook in the behind-the-ear hearing device SIGNIA S® by Siemens Audiologische Technik GmbH.

FIG. 1 shows the sectional drawing of an upper subregion of the housing of the behind-the-ear hearing device SIGNIA S® by Siemens Audiologische Technik GmbH. The upper region of the housing 1 passes into the support hook 2 with a positive fit. The support hook 2 is comprised of a titanium tube 3 and a first plastic part 4, whereby the titanium tube 3 is extrusion coated by the plastic. To fasten the titanium tube 3, a fastening clip 5 is provided that is likewise generated via extrusion coating of the titanium tube 3 with a plastic material.

The titanium tube 3 is furthermore fastened and affixed at the rear end via a clamping element 6 in the housing 1 of the hearing device. What is disadvantageous in this embodiment is that the titanium tube 3 cannot be provided with a fastening segment, for example, a threading. It is therefore not possible to achieve a detachable connection of the support hook 2 in the transition region to the housing 1 of the hearing device. In this embodiment, the titanium tube 3 also passes completely through the support hook 2. This prevents a transparent embodiment of the support hook 2.

Figure 2:
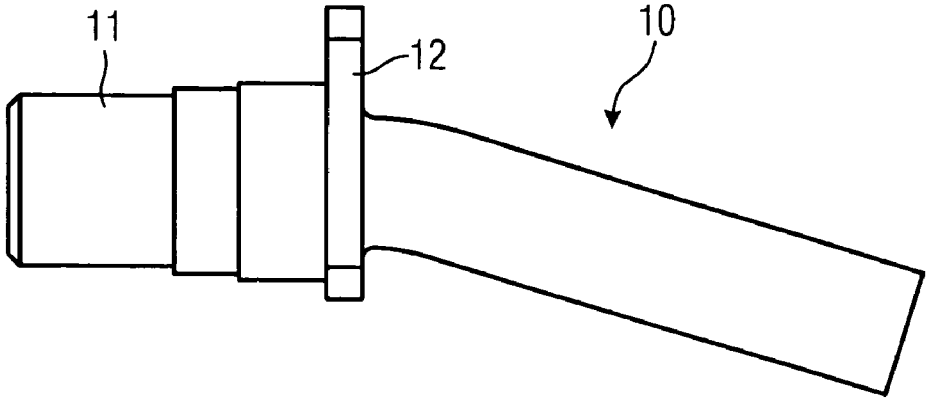
FIG 2 Prior art
FIG. 2 is a pictorial diagram illustrating a conventional connection piece with a threading.

FIG. 2 shows a known solution for the detachable fastening of a support hook to the upper end of a hearing device housing. The attachment thereby ensues to a metal connection piece 10 that is built into the upper housing end of the hearing device. The known connection piece 10 is provided at its forward end with a threading 11 on which a support hook made of plastic can be screwed. In order to absorb forces acting on the connection piece 11 and to be able to be pass them into the housing of the hearing device, the connection piece 10 comprises a stop 12 that rises relatively far over the winding in the radial direction. The stop 12 is fastened and affixed via correspondingly shaped receptacles in the housing of the hearing device. Via the relatively large projection of the stop 12, a lever/moment arm is generated that is necessary to absorb the existing forces and to transfer the forces to the hearing device housing, whereby the forces occur particularly upon fastening and detaching of the support hook. However, this design of the housing of the hearing device in the connection region of the support hook cannot exceed a specific minimum dimension.

The illustrated embodiment of the invention provides a one-part connection piece, produced from a metal or a metal alloy, with a fastening segment for detachable connection of a support hook. As is visible from the exemplary embodiment according to FIG. 3, the holding and fastening function of the connection piece 20 in the housing of a hearing device is distributed to at least two separate regions. The first region thereby forms a reduced stop 21 relative to the stop 12 according to FIG. 2. The stop 21 is provided with a radial sealing surface 22 on the front. Furthermore, an axial sealing surface 23 is located between a fastening segment of the connection piece 20 and the stop 21. Via the sealing surfaces 22 and 23, a good seal of the sound channel is ensured in the transition region from the connection piece 20 to a support hook fastened thereto.

Figure 3:
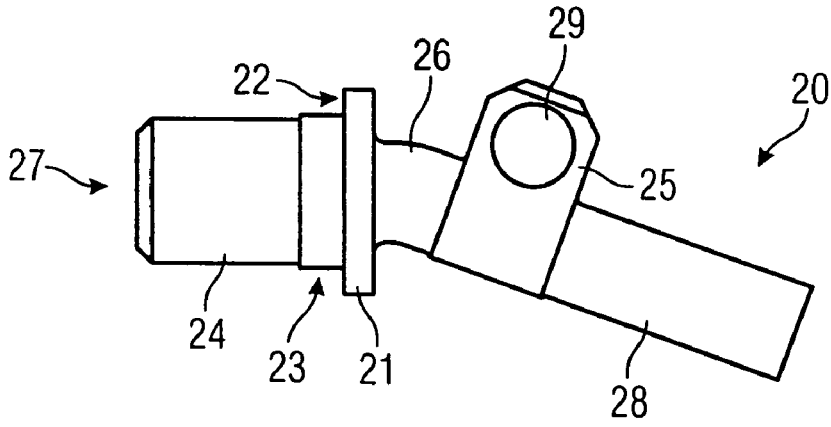
FIG. 3 is a pictorial 3D view of a first embodiment of a connection piece with a fastening clip according to an embodiment of the invention.

The fastening section at the forward end of the connection piece 20 is executed as a threading 24 in the exemplary embodiment according to FIG. 3. However, other fastening possibilities are also possible, for example, a fastening section fashioned as a latch. Furthermore, the connection piece 20 comprises a fastening clip 25 for its fastening and affixing in the housing of a hearing device. The fastening clip 25 is a component of the one-part connection piece 20. In order to allow for narrowed space relationships in the upper housing region of the hearing device, a curved tube section 26 is provided between the stop 21 and the fastening clip 25. The rear end of the connection piece 20 is also fashioned as a tube section 26. A sound channel 27 passes through the entire connection piece 20.

The connection piece 20 fashioned according to the exemplary embodiment is best suited to accept and convey the shear, traction, turning and bending moments absorbed from the support hook. In particular, via the distributed fastening mechanism (stop 21 and fastening clip 25), the necessary lever arms are fashioned in order to be able to absorb and convey the cited forces. The fastening clip 25—as shown in FIG. 3—is preferably provided with a bore 29 through which a screw or a bolt can be directed for additional anchoring of the connection piece 20 in the housing of a hearing device.

Figure 4:
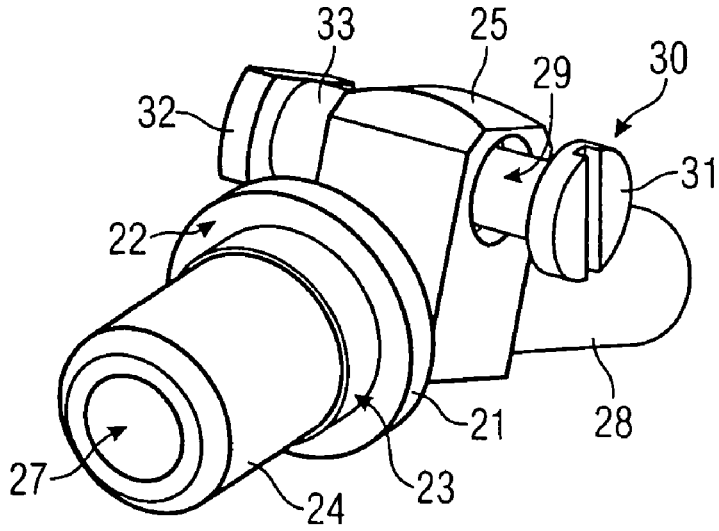
FIG. 4 is an isometric view of an embodiment with a curved first tube section.

FIG. 4 shows the connection piece 20 according to FIG. 3 in a three-dimensional representation. In particular, the sound channel 27 that passes through the entire connection piece is visible from this representation. Furthermore, FIG. 4 shows a screw 30 with a screw head 31, this screw 30 being inserted into the bore 29. A metal plate 32 with a thread bushing 33 with inner threading exists as a counterpart in which the screw 30 engages, whereby the screw head 31 of the screw 30 and the outside of the metal plate 32 at least approximately form a smooth surface with the opposite outside of the hearing device housing. A relatively large lever arm via which the cited forces can be passed into the housing of the hearing device is also created via this screw connection.

The shown exemplary embodiment enables a very narrow structural shape of the hearing device housing in the transition region between the housing and the support hook. The connection between the support hook and the housing of the hearing device is detachable, whereby a simpler exchange of a support hook is enabled. Furthermore, a particularly more inconspicuous, more transparent support hook without a metal tube passing through it can also be connected with the hearing device. Moreover, the production process of the connection piece 20 as well as a support hook that can be connected with it is thereby relatively simple, since the extrusion coating of a metal part with a plastic connection is done away with.

Figure 5:
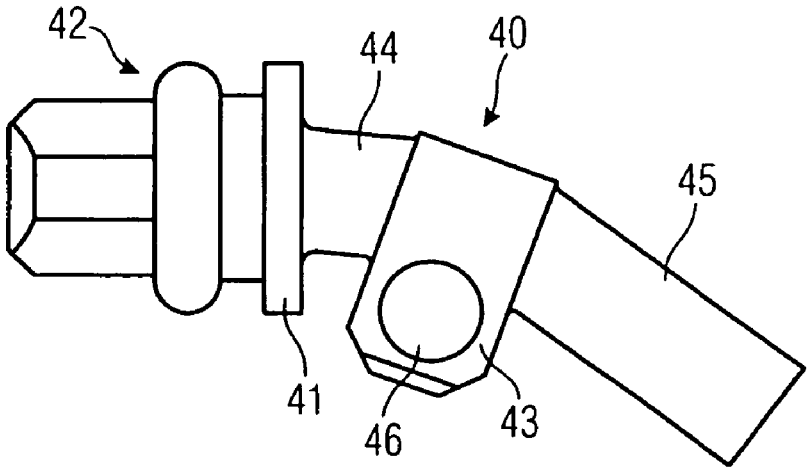
FIG. 5 is a pictorial view of an embodiment with bent tube sections.

FIG. 5 exemplarily shows various modification possibilities of a connection piece 40 according to an embodiment of the invention relative to the preferred embodiment according to FIGS. 3 and 4. The connection piece 40 also comprises a stop 41. In contrast to the exemplary embodiment according to FIGS. 3 and 4, the fastening piece to fasten a support hook is in fact fashioned as part of a latch 42. In contrast to the embodiment according to FIGS. 3 and 4, this latch 42 enables a faster and simpler exchange of the support hook fastened to the connection piece 40. The acoustic seal is, however, more elaborate.

In the connection piece 40 according to FIG. 5, the transfer of the occurring forces also ensues via two separated sub-regions, namely on the one hand via the stop 41 and on the other hand via the fastening clip 43. Furthermore, differently than in the embodiment according to FIGS. 3 and 4, a first tube section 44 between the stop 41 and the fastening clip 43 is not curved, but rather is bent both in the transition region to the stop 41 and in the transition region to the fastening clip 43, whereby the sound channel within the connection piece also experiences a buckling both in the transition region between the stop 41 and the first tube section 44 and in the transition region between the first tube section 44 and the fastening clip 43. The tube section 45 at the end of the connecting piece 40 is also bent relative to the fastening clip 43.

In further contrast to FIGS. 3 and 4, at the shown viewing angle, the fastening clip 43 according to FIG. 5 is primarily arranged not above but rather below the tube sections 44 and 45. In the shown view, the bore 46 through the fastening clip 43 is correspondingly also located below the tube sections 44 and 45.

The different embodiment of the connection piece 40 in the transition region between the stop 41, the tube section 44 and the fastening clip 43 relative to the embodiment according to FIGS. 3 and 4 is particularly dependent on different production methods, whereby the embodiment according to FIG. 5 can predominantly be produced using turning and milling methods. From a functional viewpoint, however, the curve of the connection piece according to the exemplary embodiment according to FIGS. 3 and 4 offers acoustic advantages relative to the bent sections, since a more uniform course of the sound channel within the connection piece is created via the curve.

If a connection piece with an initially straight course of the sound channel is not only curved in the region of the first tube section, but rather is clamped to the fastening section as well as to the second tube section and is curved over this entire region, in practice both curves in the tube sections (as illustrated in FIG. 3) and bent regions in the transitions to the stop or to the fastening clip, as they are visible from FIG. 5, result via the stretching and upsetting deformation/buckling. The curving event thereby preferably ensues under heat exposure.

In addition to both shown exemplary embodiments, a plurality of further geometric modifications that lie in the scope f the invention is possible.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE CHARACTERS

1 housing
2 support hook
3 titanium tube
4 first plastic part
5 fastening clip
6 clamping element
10 metal connection piece
11 connection piece
12 stop
20, 40 connection piece
21, 41 stop
22 radial sealing surface
23 axial sealing surface
24 threading
25, 43 fastening clip
26, 44 curved tube section
27 sound channel
28, 45 tube section
29 bore
30 screw
31 screw head
32 metal plate
33 thread bushing
42 latch/fastening section

What is claimed is:

1. A one-part, metallic connection piece for a hearing device support hook, comprising:

a sound channel passing through the connection piece;

a fastening section configured for detachable fastening of the support hook;

a stop attached to the fastening section;

a curved or bent first tube section attached to the stop;

a second tube section; and a fastening clip that is arranged between the first tube section and the second tube section.

2. The connection piece according to claim 1, wherein the second tube section is also curved or bent.

3. The connection piece according to claim 1, wherein the first tube section is bent in a transition region to the stop.

4. The connection piece according to claim 1, wherein the first tube section is bent in a transition region to the fastening clip.

5. The connection piece according to claim 1, wherein the second tube section is bent in a transition region to the connection piece.

6. The connection piece according to claim 1, wherein the fastening clip comprises a bore through which a fastening element can be at least partially directed.

7. The connection piece according to claim 6, wherein a screw or a bolt is provided as a fastening element.

8. The connection piece according to claim 1, wherein the fastening section utilizes a threading.

9. The connection piece according to claim 1, wherein the fastening section is executed as part of a latch.

10. The connection piece according to claim 1, wherein at least one sealing surface is provided between the fastening section and the stop.

* * * * *